United States Patent [19]

Moflag

[11] 4,224,782

[45] Sep. 30, 1980

[54] WRAPPING MACHINE

[75] Inventor: Per Moflag, Sandnessjøen, Norway

[73] Assignee: Thune-Eureka A/S, Tranby, Norway

[21] Appl. No.: 9,814

[22] Filed: Feb. 6, 1979

[30] Foreign Application Priority Data

Feb. 16, 1978 [NO] Norway ..... 780535

[51] Int. Cl.[3] ..... B65B 11/04

[52] U.S. Cl. ..... 53/587; 53/211

[58] Field of Search ..... 53/118, 587, 211, 212, 53/218; 100/15

[56] References Cited

U.S. PATENT DOCUMENTS

| | | | |
|---|---|---|---|
| 1,764,081 | 6/1930 | Jones et al. | 53/211 X |
| 2,675,810 | 4/1954 | Wheeler | 53/211 X |
| 3,013,367 | 12/1961 | Sarre | 53/211 X |

*Primary Examiner*—John Sipos

*Attorney, Agent, or Firm*—Young & Thompson

[57] ABSTRACT

An apparatus for a wrapping machine in which a length of packing material is wound around a cylindrical object, especially a roll of paper, said apparatus comprising endless members, such as belts or cords, led over rollers, said endless members being in contact with the applied length of packing material in the circumferential direction of the roll during winding and serving to tighten the length of packing material around the cylindrical object. Three endless members are positioned consecutively in the circumferential direction of the cylindrical object and guided over rollers, said endless members being springbiased to lie against the length of packing material, the inner side of the outwardly-facing running section of the middle endless member passing over a stationary roller, and the breast rollers for all of the endless members being supported by arms in a power-operated pivotal arm system having a common, stationary pivot point on a line through the center of the cylindrical object and the center of the stationary roller.

6 Claims, 2 Drawing Figures

Figure 1:
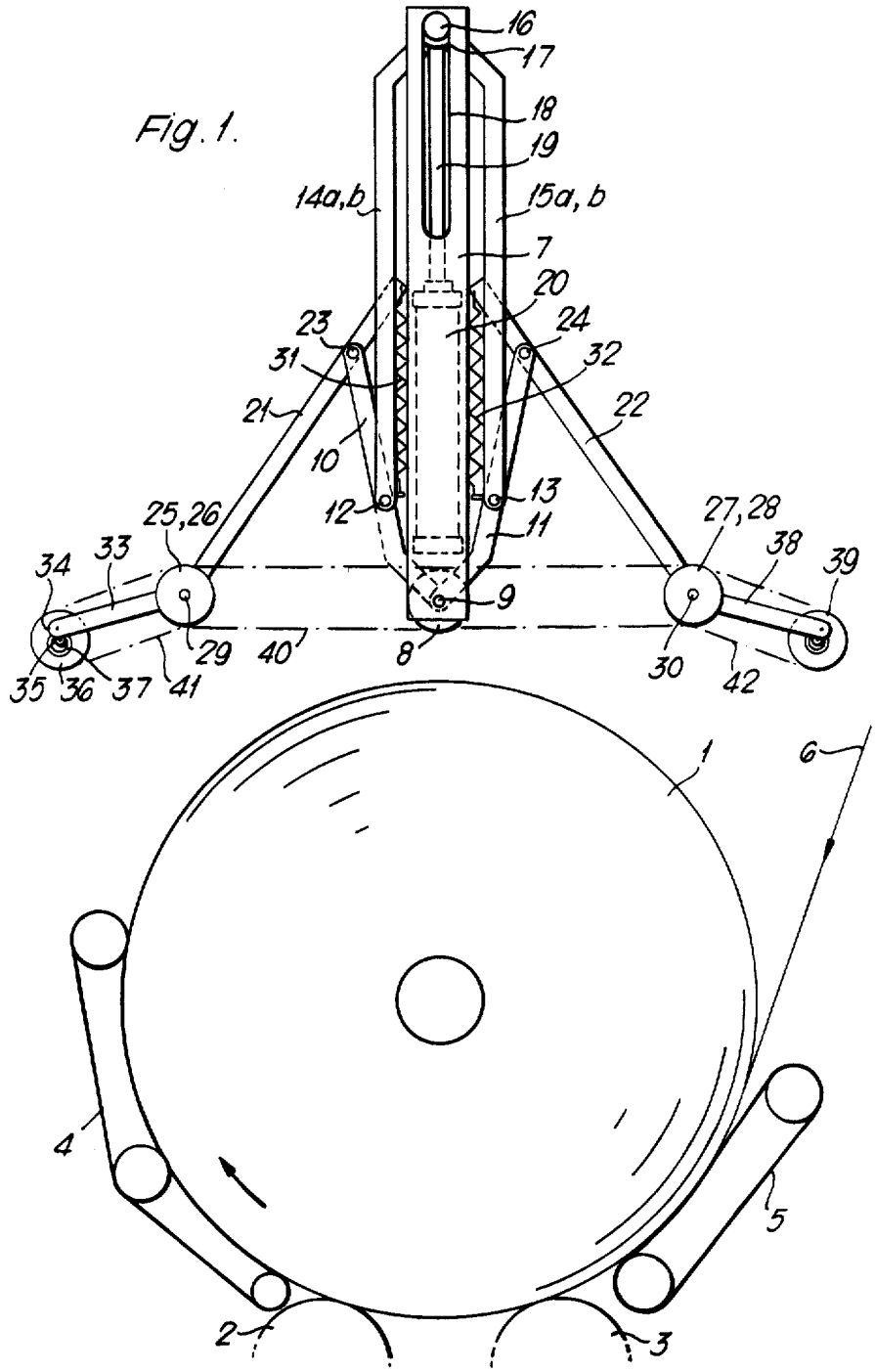

19
14a,b
15a,b
31
32
21
22
10
11
40
8
25,26
27,28
33
38
41
42
36
39

WRAPPING MACHINE

The invention pertains to a wrapping machine of the type in which a length of packing material is wound around a cylindrical object, especially a roll of paper, said apparatus comprising members, such as belts or cords, led over rollers and lying in contact with the applied section of packing material during winding, tightening the packing material around the cylindrical object.

The invention has been developed in respons to the problems encountered in wrapping alternately large and small rolls of paper in so-called roll wrapping machines. In such machines, the rolls of paper are guided forward one at a time to a wrapping site where a length of packing material, often stiff type of paper, is guided forward and wound three or four times around the roll as tightly as possible. Adhesive is applied to the length of packing material to fasten it. After the length of packing material has been wound around the paper roll the desired number of times, the edge portions of the packing material which project out beyond the ends of the roll of paper are folded in toward a circular end piece which is placed on the end of the roll, and another end piece is placed on the outside thereof and adhered thereto. The roll of paper is then in a finished packed state and exits from the roll wrapping machine.

It is desirable that the length of packing material be wound as tightly and smoothly as possible around the roll of paper, and to facilitate this it is known to use cords, led over rollers, which are in contact with the length of packing material on the roll of paper, and it is also known to use pressure rollers and the like. Such machine components must be made and mounted such that they can be swung away or removed from the wrapping site to provide room for the roll of paper to be inserted and removed. In a typical, known apparatus, the roll of paper rests on driven rollers and the lower half of the paper roll circumference is acted upon by cords led over rollers, these machine members being pivotally mounted in suitable frames such that they can be swung down with the floor of the assembly in order to provide room for the insertion and removal of the roll of paper. However, it is also desirable that such cord arrangements be used on the upper half of the roll of paper. It is known in this connection to use a cord arrangement which affects a portion of the circumference of the upper half of the paper roll. It is also known to utilize pressure rollers which act upon the upper portion of the roll. All of these arrangements are made such that the components can be swung away to provide room for the roll of paper to enter and exit.

A clear need exists for a roll wrapping machine which is capable of packing rolls of paper of various sizes, in regard both to diameter and length, and the known tightening means are not suited for use on paper rolls whose diameters deviate to a large degree. It has heretofore been necessary to change some of the tightening components to accomodate a smaller or larger roll diameter, for example. This is time-consuming and increases the packing costs. It is the especial purpose of the invention, therefore, to provide a tightening means for the length of packing material which can be utilized within a large range of diameters and which covers most of the circumference of the upper half of the roll of paper. The tightening means should also be able to be pivoted out of the path of advancement for the paper roll in a simple manner, such that it does not obstruct the advancement of the paper roll to the wrapping site or its exit therefrom.

In accordance with the invention, therefore, an apparatus is provided for a wrapping machine in which a length of packing material is wound around a cylindrical object, especially a roll of paper, said apparatus comprising endless members, such as belts or cords, led over rollers, which are in contact with the applied section of packing material in the circumferential direction during winding and tighten the length of packing material around the cylindrical object, and that which characterizes the apparatus according to the invention is that three consecutive endless members in the circumferential direction of the cylindrical object are utilized, said endless members being led over rollers and being spring-biased to lie against the length of packing material, the inner side of the outwardly-facing running section on the middle endless member passing over a stationary roller, and the rollers for all of the endless members being supported by the arms of a power-operated pivotal arm system having a common, stationary pivot point on a line through the center of the cylindrical object and the center of the stationary roller. Preferably, the pivot point lies in the center of the stationary roller.

With such an arrangement, one obtains a tightening arrangement which covers a large portion of the circumference of the upper half of the prone cylindrical object and which can easily be pivoted toward and away from the cylindrical object. Because the embodiment comprises several consecutive endless members, the apparatus can be adapted to fit rolls whose diameters vary within a large range.

The apparatus is preferably made such that two pivot arms extend out from the pivot point, symmetrical about the line through the center of the cylindrical object and the pivot point, each pivot arm at a distance removed from the pivot point being articulated to a guide arm which extends up beyond the pivot arm and is articulated to the corresponding guide arm from the other pivot arm at a point on said line, such that a parallelogram linkage is formed in which the hinge coupling for the guide arms can be moved toward and away from the pivot point. Each pivot arm, at a distance removed from the pivot point, is also articulated to a first support arm on which a roller for the middle endless member and for one of the two other endless members is rotatably mounted. Extending from the center of rotation for each roller is a second support arm which is pivotally supported at the said center of rotation, and a roller for the first and the last endless members, respectively, is rotatably supported at the end of the second support arm. A drive means is provided for moving the hinge coupling for the guide arms toward and away from the pivot point.

By operating the drive means, one can move the hinge coupling for the guide arms toward and away from the pivot point, thereby also effecting a movement of the support arms toward and away from the cylindrical object.

The respective first support arms are preferably springbiased for tightening the middle endless member. In this way, one obtains a good adaptability to the cylindrical object, and any unevenness in the initial contact will quickly be compensated for.

For tightening the first and the last endless members, seen in the direction of winding for the packing material, the respective breast rollers for these endless members, which are mounted at the ends of the second support arms, can be eccentrically mounted on their respective support arms by a crank arrangement, with spring-biasing of the crank.

The invention will be elucidated further with reference to the accompanying drawings, which depict schematically an end view of an apparatus made in accordance with the invention.

Figure 2:
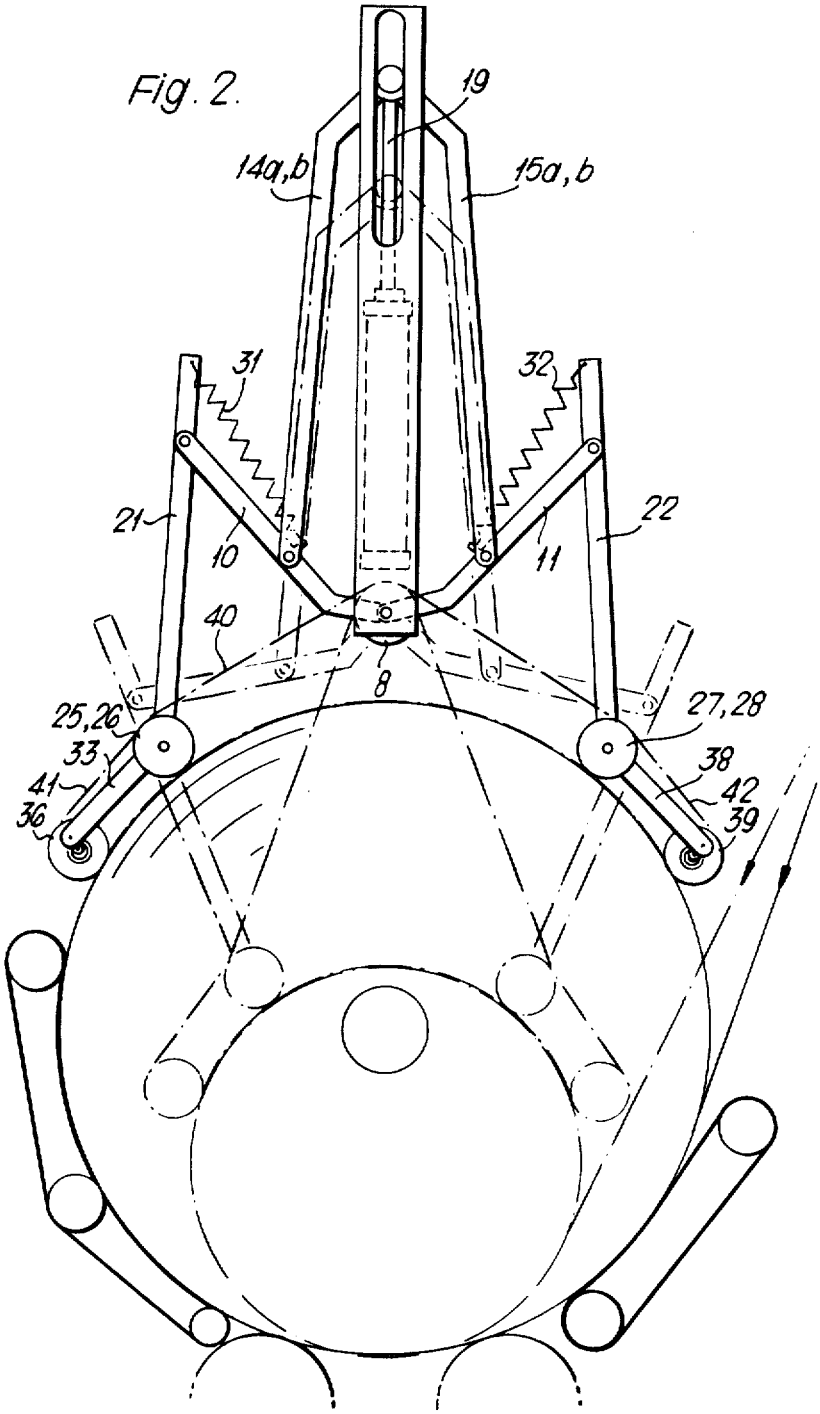

FIG. 1 is a schematic end view of an apparatus in accordance with the invention, in the non-working position, i.e., drawn up and out of the path of advancement and exit for a roll of paper which is to be packed, and FIG. 2 shows the apparatus of FIG. 1 in a working position, with a second working position for a roll of paper of substantially smaller diameter also being indicated by dotted lines.

FIG. 1 shows a roll of paper 1 which rests on two support and rotation rollers 2, 3. The roll of paper 1 is guided, for example, in to the wrapping site from the left on the drawing, and exits to the right. On both sides of the roll of paper are tightening arrangements 4 and 5 in the form of cords which are guided over rollers. These tightening arrangements are pivotally mounted, in a manner known per se and not illustrated on the drawing, such that they can be pivoted out of the path of advancement and exit for the roll of paper 1. On FIG. 1, they are shown pivoted up and in contact with the roll of paper. A length of packing material 6 above and to the right of the roll of paper is guided forward in a manner which is known per se and not illustrated in further detail on this drawing. The length of packing material travels between the cord arrangement 5 and the roll of paper 1, continues down between the paper roll and the support and rotation rollers 2, 3, and passes further between the paper roll and the tightening arrangement 4. The support and rotation rollers 2, 3 are driven and cause the roll of paper to turn in the direction indicated by the arrow.

The region from the upper termination of the cord arrangement 4 and over to the advancing length of packing material 6 ought also to be affected by a tightening arrangement, and in the embodiment example this region is covered by the apparatus shown on FIG. 1. This apparatus consists of a frame 7 which is fixed to the machine, i.e., it is arranged so as to be stationary in the roll wrapping machine, which is not otherwise shown in further detail; the machine components described up to now constitute parts of the machine. At the bottom of the frame 7, a roller 8 is rotatably mounted. The center of rotation for the roller is designated 9, and this center of rotation constitutes at the same time a pivot point for two pivot arms 10 and 11. The pivot arms 10 and 11 extend outwards relative to the roll of paper 1 and at the points of articulation 12, 13 are linked to respective guide arms 14*a*, *b* and 15*a*, *b*. In actuality there are four such guide arms 14 and 15, i.e., two on each side of the frame 7 and arranged one on each side of the respective pivot arms 10 and 11. The guide arms 14, 15 extend further upwards and are brought together at a common hinge point 16. A journal 17 at the hinge point 16 can move in an open guide slot 18 in the frame 7, and the hinge point 16 is articulated to a piston rod 19 of a power cylinder 20 rigidly mounted inside the frame 7.

On the end of each pivot arm 10, 11, first support arms 21, 22 are pivotally mounted at articulated connections 23, 24. These first support arms 21, 22 extend downwards toward the roll 1, and cord rollers 25, 26 and 27, 28, respectively, are rotatably supported in the respective lower ends thereof. The first support arm thus supports two rollers 25, 26, whose common axis of rotation is designated 29, while the first support arm 22 supports two cord rollers 27, 28, whose common axis of rotation is designated 30. Only one of the cord rollers on each support arm can be seen on the drawing, the other respective rollers being located behind the rollers visible on the drawing.

Said first support arms 21, 22 are extended upwards beyond the respective articulated connections 23, 24 and at the upper ends thereof are connected to respective springs 31, 32. The spring 31 extends down to the associated pivot arm 10, the lower end of the spring being attached to the arm 10, and the lower end of the spring 32 is similarly connected to its associated pivot arm 11. The springs 31, 32 exert a spring force on the support arms 21 and 22 and also try to lift the rollers 25 through 28.

Pivotally supported on the first support arm 21 is a second support arm 33. The support arm 33 is limitedly pivotal about the axis of rotation 29, and on FIG. 1 it is shown in its lowermost position. The outer end of the second support arm 33 is pivotally connected at 34 to a crank 35 on which a cord roller 36 is rotatably mounted. The crank 35 is affected by a coil spring 37 which urges the cord roller 36 to move in the direction away from the cord roller 26. A second support arm 38 is mounted in a similar manner, with the center of rotation 30 as its axis of rotation. This support arm also has limited pivotability and is shown in its lowermost position on FIG. 1. A cord roller 39 is supported on a crank in the same way as the roller 36, and the crank is also in this case affected by a spring which tries to push the cord roller 39 in a direction away from the cord roller 28.

Around the two cord rollers 25, 27, i.e., the rollers visible on FIG. 1, a cord 40 is passed, the upper running section thereof also passing over the cord roller 8 which is rotatably mounted in the frame 7. A cord 41 is led around the cord roller 36 and the cord roller 26, which is positioned in back of the cord roller 25 visible on FIG. 1, and a cord 42 is similarly run over the cord roller 39 and the cord roller 28.

As mentioned above, the apparatus is in a non-working position on FIG. 1. The piston rod 19 is driven up and the hinge coupling 16 in the parallelogram linkage formed by the guide arms 14, 15 and the pivot arms 10, 11 is thus in its upper position, and one can see that the journal 17 for the hinge coupling is positioned at the top of the slot 18 in the frame 7. The cord rollers and associated cords are in a position above the roll of paper 1 and thus do not obstruct its introduction into or exit from the wrapping site, i.e., the location at which the roll of paper is provided with a covering of packing material.

On FIG. 2, the apparatus is shown in a working position; a second working position for a roll of paper of substantially smaller diameter is shown with dotted lines.

The piston rod 19 has been driven a distance into its cylinder 20 and the hinge coupling 16 with its associated journal 17 has moved down in the slot 18 in the frame 7. This has caused the parallelogram linkage to spread out, with a subsequent downward and outwardly directed pivoting of the pivot arms 10, 11. The cord rollers 25 and 27 have been brought into contact against the roll of paper, i.e., against the packing paper 6 that has been wound around the roll, and in a similar manner the cords 41, 42 and their rollers 36, 26 and 39, 28, respectively, are in contact with the circumference of the roll of paper. The cord rollers can naturally have a weaker or stronger contact against the periphery of the paper roll, or can optionally be formed such that only the respective cords have direct contact with the length of packing material. It is clear from the described configuration of the structure that the cord arrangements will tighten against the length of packing material and that the way in which the cord arrangements are made and supported in the pivotal arm system will permit the tightening means to adapt easily to the circumference of the roll. Any unevenness in the initial contact will quickly be compensated by the springs that are utilized.

The dotted lines on FIG. 2 indicate a position assumed by the cord arrangements when a roll of paper of a substantially smaller diameter is to be packed. As mentioned above, the second support arms 33, 38 have limited pivotability, and upon their contact with the roll of paper which is in the process of being packed, these second support arms will be influenced to pivot in an upwards direction, i.e., in a direction away from the non-working position shown on FIG. 1. The weight of the support arms will usually be sufficient to cause the cords to tighten against the periphery of the roll of paper.

The apparatus of the invention is utilized in the following manner: Starting in the position shown on FIG. 1, a roll of paper 1 is guided into position shown on FIG. 1, a roll of paper 1 is guided into position at the wrapping site, such that the roll of paper rests on the driven rollers 2 and 3. The cord arrangements 4 and 5 are brought up and a length of packing material 6 is advanced as shown. The roll of paper is made to rotate, and the length of packing material follows along. As soon as the roll of paper 1 has come into position on the rollers 2, 3, the cord arrangements 41, 40, 42, come down, i.e., they are brought into the position shown on FIG. 2, and the length of packing material will then also pass beneath these cords. After three to four turns of the roll one has obtained a sufficiently thick layer of packing material, and the length of packing paper 6 is cut and provided with adhesive. As the roll of paper continues to turn, the section of packing paper will be held tight at all times by means of the cord arrangements, and the packing material is then glued to the underlying layer. The apparatus with the cord arrangements 41, 40, 42 is then retracted, i.e., into the position shown on FIG. 1, and the cord arrangements 4, 5 let down, and the finished wound roll can then be led away by means which are not shown on the drawing. As can be seen from FIG. 2, the apparatus according to the invention is able to adapt to very great deviations in the diameters of the rolls being packed, and one thus obtains with the invention an apparatus which is able to provide the required tightening for small as well as large rolls.

The cord arrangements are preferably positioned centrally on the roll, in that it will usually be necessary to have only one apparatus, even when wrapping relatively long rolls of paper. If required, of course, one could position several such apparatus beside one another in the longitudinal direction of the roll of paper. The cord rollers are non-driven, but if desired one could of course also provide the rollers with drive motors.

Having described my invention, I claim:

1. In a wrapping machine in which a length of packing material is wound around a cylindrical object, said apparatus comprising endless members led over rollers, said endless members being in contact with the applied length of packing material in the circumferential direction of the cylindrical object during winding and serving to tighten the length of packing material around the cylindrical object; the improvement in which said endless members comprise three endless members positioned consecutively in the circumferential direction of the cylindrical object and guided over rollers, said endless members being spring-biased to lie against the length of packing material, the inner side of the outwardly-facing running section of the middle endless member passing over a stationary roller, the rollers for all the endless members being supported by arms in a power-operated pivotal arm system having a common, stationary pivot point on a line through the center of the cylindrical object and the center of the stationary roller, two pivot arms extending out from the pivot point, symmetrically about the line through the center of the cylindrical object and the pivot point, each pivot arm being articulated at a distance removed from the pivot point to a guide arm which extends out beyond the pivot arm and is articulated to the guide arm for the other pivot arm at a hinge coupling on said line, such that a quadrilateral linkage is formed in which the hinge coupling for the guide arms can be moved toward and away from the pivot point, each pivot arm at a distance removed from the pivot point being articulated to a first support arm, a roller for the middle endless member and for one of the two outer endless members rotatably supported on each said first support arm, a second support arm articulated to each said first support arm and limitedly pivotal about the center of rotation of each roller, a roller for the outer endless member rotatably supported at the end of each said second support arm, and drive means for moving the hinge coupling for the guide arms toward and away from the pivot point.

2. An apparatus according to claim 1, characterized in that the pivot point lies in the center of the stationary roller.

3. An apparatus according to claim 1, characterized in that the respective first support arms are spring-biased for tightening of the middle endless member.

4. An apparatus according to claim 1, characterized in that the rollers supported on the respective second support arms are eccentrically supported by a crank on the second support arm and are spring-biased for tightening of the respective endless members.

5. An apparatus according to claim 1, characterized in that the hinge coupling between the guide arms comprises a journal which is guided in a slot along the said line, and that a power cylinder is connected to the parallelogram linkage for movement of the hinge coupling toward and away from the pivot point.

6. An apparatus according to claim 1, characterized in that the respective first support arms are spring-biased for tightening of the middle endless member, in that the rollers supported on the respective second support arms are eccentrically supported by a crank on the second support arm and are spring-biased for tightening of the respective endless members, in that the hinge coupling between the guide arms comprises a journal which is guided in a slot along said line, and that a power cylinder is connected to the parallelogram linkage for movement of the hinge coupling toward and away from the pivot point.

* * * * *